US005435547A

United States Patent [19]

Lee

[11] Patent Number: 5,435,547

[45] Date of Patent: Jul. 25, 1995

[54] GOLF PUTTING PRACTICE DEVICE

[76] Inventor: Do W. Lee, 1808 Daeyeon-Dong, Daeyeonsamikbeach Apt. 105-1103, Nam-ku, Pusan, Rep. of Korea

[21] Appl. No.: 269,387

[22] Filed: Jun. 30, 1994

[30] Foreign Application Priority Data

Apr. 7, 1994 [KR] Rep. of Korea ..... 94-7443

[51] Int. Cl.[6] ..... A63B 69/36

[52] U.S. Cl. ..... 273/186.1; 273/192

[58] Field of Search ..... 273/186.1, 192, 191 R, 273/186.2, 186.3

[56] References Cited

U.S. PATENT DOCUMENTS

| | | | |
|---|---|---|---|
| 3,009,704 | 11/1961 | Heart | 273/186.1 X |
| 3,332,688 | 1/1965 | Gevertz | 273/192 |
| 3,471,155 | 10/1969 | Donaldson | 273/192 X |
| 3,685,833 | 8/1972 | Jack | 273/186.1 X |
| 3,868,116 | 2/1975 | Ford et al. | 273/192 X |
| 3,885,796 | 5/1975 | King | 273/192 X |
| 3,934,874 | 1/1976 | Henderson | 273/192 X |
| 4,082,287 | 4/1978 | Berkey | 273/192 X |
| 4,153,255 | 5/1979 | Woodson | 273/192 X |
| 4,230,319 | 10/1980 | Lindner | 273/192 |
| 4,306,722 | 12/1981 | Rusnak | 273/186.1 X |
| 4,453,717 | 6/1984 | Solheim et al. | 273/192 |
| 4,826,174 | 5/1989 | Hoyt, Jr. | 273/192 |
| 5,007,646 | 4/1991 | Baber et al. | 273/192 X |
| 5,246,233 | 9/1993 | Sheltman et al. | 273/192 X |
| 5,282,627 | 2/1994 | Beck | 273/192 X |

*Primary Examiner*—George J. Marlo

*Attorney, Agent, or Firm*—Birch, Stewart, Kolasch & Birch

[57] ABSTRACT

A golf practice and training device which includes a longitudinal channel having a pair of parallel walls and a flat bottom surface, the walls and flat bottom having a straight line sensor and a right angle sensor, respectively, and a plurality of visual indicia designs disposed on a centrally sloped flat top surface extending from both ends, whereby the device allows a golfer to train and practice accurate putting.

9 Claims, 3 Drawing Sheets

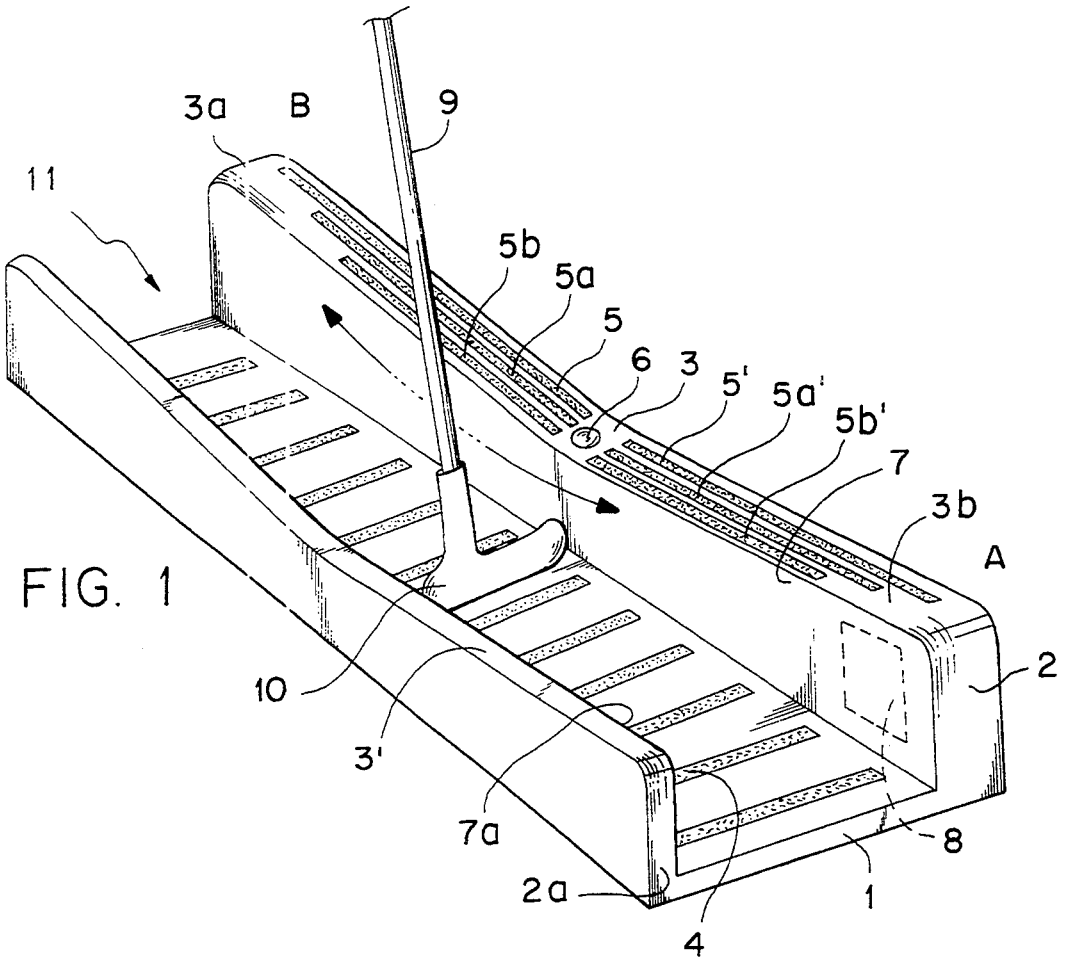
FIG. 1
FIG. 2
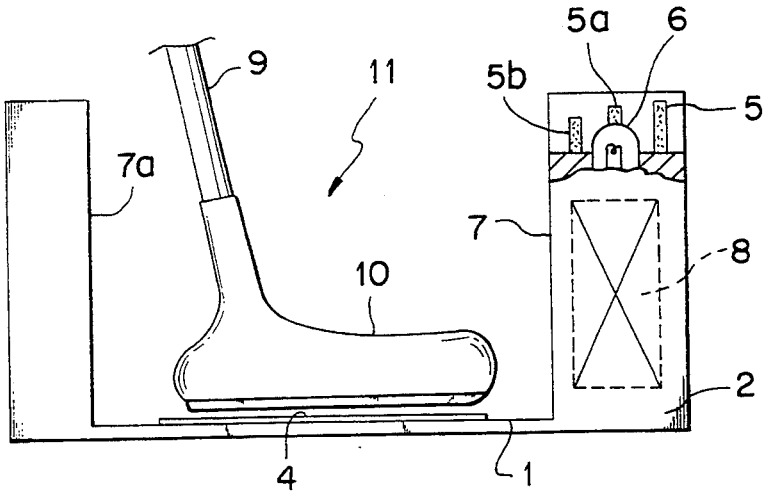

GOLF PUTTING PRACTICE DEVICE

BACKGROUND OF THE INVENTION

1. Field of the Invention

The present invention relates to an improved golf putting practice device and more particularly, to a device for training and practicing putting a golf ball more accurately.

2. Description of Related Art

Various types of golf putting practice devices for training and practicing putting a golf ball are generally in the art to be utilized with a guide member consisting of a flat rectangular shaped base and a pair of elongated vertically spaced apart and parallel side rails.

However, these golf putting practice devices suffer from a number of problems such as, for example, it is difficult for the user to perceive rectilinear movement of the putter; it is impossible to practice strong and weak control of the swing distance based on the distance of the ball from the hole, and it is difficult for a user to perceive and confirm visually that the putter is squarely at right angles with a base of the device.

Such golf putting practice devices are described in Gevertz, U.S. Pat. No. 3,332,688; Donaldson, U.S. Pat. No. 3,471,155; King, U.S. Pat. No. 3,885,796; Ford et al., U.S. Pat. No. 3,868,116; Henderson, U.S. Pat. No. 3,934,874; Berkey, U.S. Pat. No. 4,082,287; Woodson, U.S. Pat. No. 4,153,255; Lindner, U.S. Pat. No. 4,230,319; Solheim et al., U.S. Pat. No. 4,453,717; Hoyt, Jr., U.S. Pat. No. 4,826,174; Baber et al., U.S. Pat. No. 5,007,646; Sheltman et al., U.S. Pat. No. 5,246,233; and Beck, U.S. Pat. No. 5,282,627.

SUMMARY OF THE INVENTION

Accordingly, it is an object of the present invention to provide an improved golf putting practice device for a person to train and practice putting a golf ball more accurately, which eliminates the above problems encountered with conventional golf putting practice devices.

Another object of the present invention is to provide a golf putting practice device which includes a guide member consisting of a flat rectangularly shaped base with a plurality of right angle indicators, an angle sensor, and a pair of elongated vertically spaced apart and parallel side rails with a straight line sensor and a plurality of swing distance indicators, whereby a user can train and practice accurate putting by use of the present invention.

Still another object of the present invention is to provide a golf putting practice device which is simple in structure, inexpensive to manufacture, durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a golf putting practice device which includes a longitudinal channel containing a pair of parallel walls and a flat bottom surface, the walls and flat bottom having a straight line sensor and a right angle sensor, respectively, and a plurality of visual indicia designs disposed on a centrally sloped flat top surface and extending from both ends of the device, whereby the device allows a golfer to train and practice accurate putting.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 1 is a perspective view of a golf putting practice device in accordance with the present invention;

FIG. 2 is a cross-sectional view of the golf putting practice device in accordance with the present invention;

DESCRIPTION OF THE PREFERRED EMBODIMENTS

Figure 3:
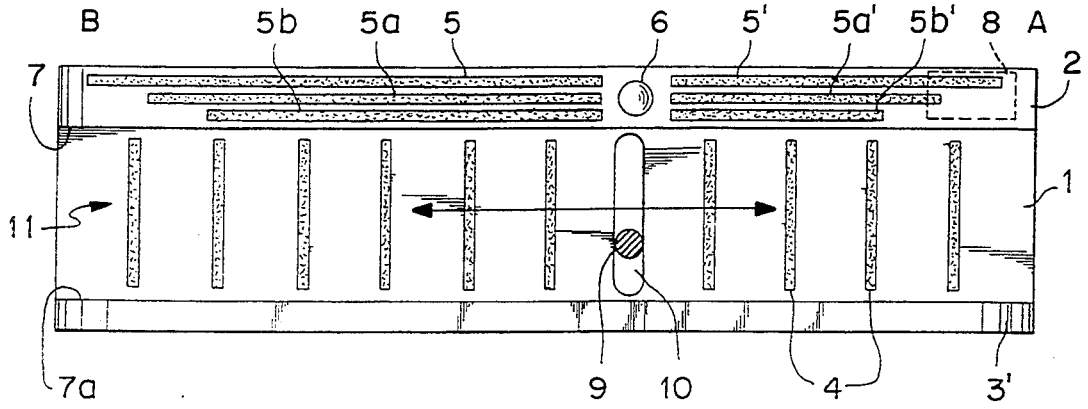
FIG. 3 is a top plan view of the golf putting practice device in accordance with the present invention.

Referring now in detail to the drawings for the purpose of illustrating the preferred embodiments of the present invention. The golf putting practice device as shown in FIGS. 1, 2, and 3, comprises a guide member 11 including a flat rectangular shaped base 1 and a pair of elongated vertically spaced apart and parallel front and rear side rails 2 and 2*a*. A plurality of visual indicia design right angle lines 4 are disposed on the flat rectangular shaped base. Swing lines 5, 5′, 5*a*, 5*a*′ and 5*b*, 5*b*′ are disposed on the front side rail. A sensor 8 is connected to an induction lamp 6 for turning on a light when a head 10 of a putter 9 touches one of the front or squarely rear walls 7 or 7*a* of the side rails 2 or when the head 10 is not disposed squarely at a right angle with the flat base 1.

Figure 4:
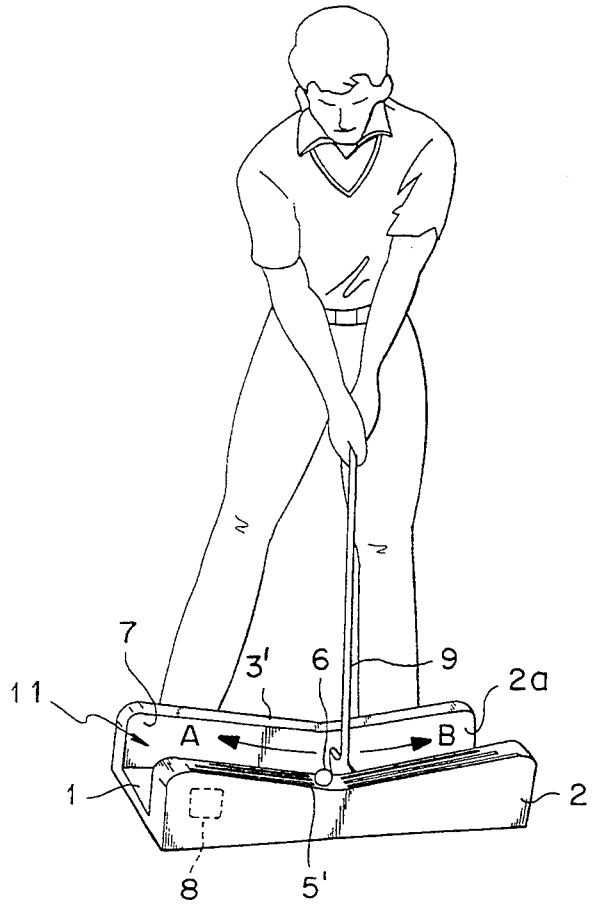
FIG. 4 is a perspective view of the golf putting practice device in accordance with the present invention and showing the device in use.

The front and rear rails 2 and 2*a* are provided with front and rear "V" shaped tops 3 and 3′ for following the swing track of the putter 9. The front "V" shaped top 3 defines a left top 3*a* and a right top 3*b*. Since the front wall 7 has a thick size, the "V" shaped top 3 has a wide surface so that the induction lamp 6 is disposed at the middle thereof. A plurality of colored visual left indicia design lines 5, 5*a* and 5*b*, and a plurality of colored visual right indicia design lines 5′, 5*a*′ and 5*b*′, are disposed on the left top 3*a* and right top 3*b* of the front "V" shaped top 3, respectively. These visual indicia design lines 5, 5′, 5*a*, 5*a*′, 5*b*, and 5*b*′ are applied to control the putting power of the user according to the distance to the hole from the ball. That is, for example, lines 5 and 5′ are a long distance and a first color, lines 5*a* and 5*a*′ are a middle distance and a second color, and lines 5*b* and 5*b*′ are a short distance and a third color. Also, as shown in FIG. 4, the left top 3*a* is a back swing distance (A) and the right top 3*b* is a back swing distance (B). Accordingly, when the distance to the hole from the ball is short, the user practices to use the short indicia design lines 5*b* and 5*b*′, and when the distance is long, the user uses the long indicia design lines 5 and 5' (FIGS. 1 and 3).

To practice putting with the golf putting practice device according to the present invention, the practicing golfer positions his feet at a proper stance and the golf ball (not shown) is positioned on the flat base, and near the induction lamp 6. At this time, the putter head 10 is positioned above the flat base 1 of the guide member 11 and behind the golf ball. Thereafter, the practice golfer is able to direct his putting swing in a straight line without touching both walls 7 and 7*a* and crossing squarely with the flat base 1.

If the putter head 10 is touched to one of the walls or both walls 7 and 7*a*, or is not crossed with the flat base 1 at a right angle, the induction lamp 6 is turned on, thus indicating a necessity for correcting the swing. Also, the practicing golfer can control the putting power by use of the plurality of colorful indicia design lines 5, 5*a*, 5*b*, 5', 5*a'*, and 5*b'* in the back and finishing swings, thus correcting the swing.

The sensor 8 disposed in the front wall 7 includes a detector system which senses when the putter head 10 touches at least one of the walls 7 and 7*a* or the flat base 1. Additionally, the sensor 8 senses when the putter head 10 does not cross with the bottom of the flat base 1 at a right angle, as described below. The sensor 8 is connected to an electric source such as a rechargeable battery (not shown) and to the induction lamp 6. The plurality of visual right angle lines 4 visually help a golfer to cross the flat base 1 with the head 10 of the putter 9 squarely at a right angle. Also, a buzzer can be connected to the sensor 8 for actuating when the putter head 10 does not cross with the flat base 1 at a right angle.

Figure 5:
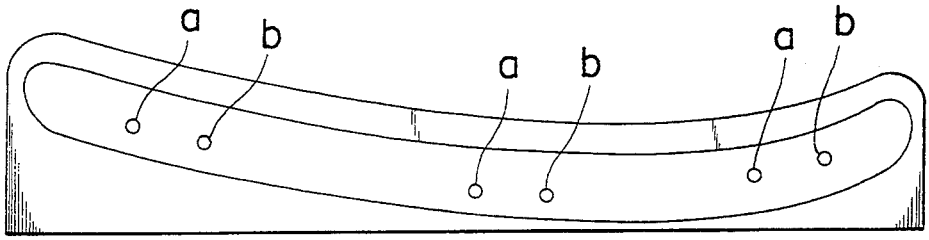
FIG. 5 is a front view of a wall of the golf putting practice device containing sensors for detecting the angular position of the head of the putter.
Figure 6:
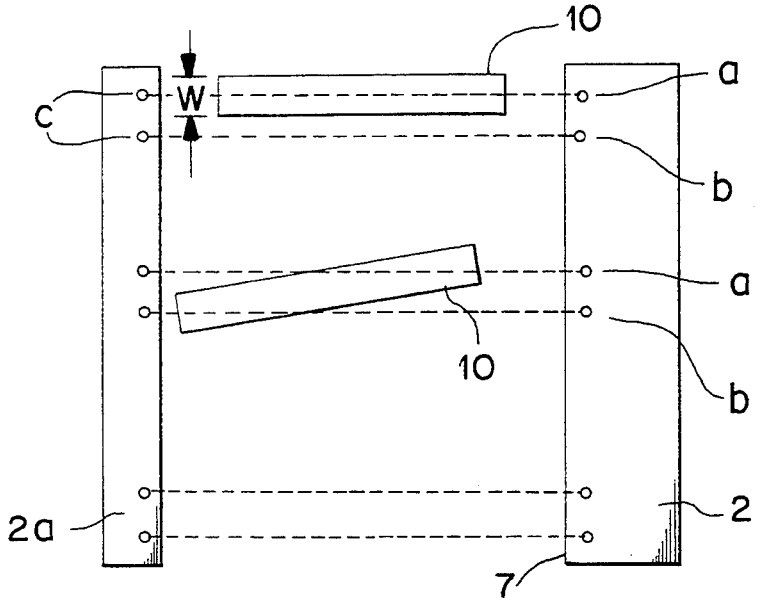
FIG. 6 is a top view of a sensor of the golf putting practice device for detecting the angular position of the head of the putter.

FIGS. 5 and 6 illustrate the operation of the sensor for detecting when the head of the putter does not cross with the bottom of the flat base 1 at a right angle. The sensor includes a series of beam emitting device pairs a, b disposed along the front wall 7 of the front side rail 2. The front emitting beam devices "a" are disposed a distance greater than the width w of the putter head 10 away from the rear emitting beam devices b. Beam receiving sensors are disposed on the rear side rail in order to sense the beams emitted by the beam emitting device pairs.

FIG. 6 illustrates how the sensors detect when the putter head is not disposed at a right angle with the bottom of the flat base. As the putter is swung through the swing arc, if the putter head 10 blocks only one beam at a time, then the putter head 10 is at a right angle with the flat base 1. However, if two beams are blocked, a signal is sent to the sensor 8 to illuminate the induction lamp 6 or to activate a buzzer.

Accordingly, as shown in FIG. 4, the golf putting practice device according to the present invention permits one to develop a natural putting stroke in a simple and efficient manner without actually fettering or restraining the putter 9. If the practicing golfer's swing deviates excessively from the natural swing, the golf putting practice device of the present invention will be touched by the putter head 10 or the sensors will detect if the putter head is not swung squarely relative to the base, thus correcting the swing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf putting practice device comprising:

a guide member including a flat base, a pair of elongated vertically spaced apart and generally parallel side rails disposed along said flat base, a plurality of visual indicia design angle lines disposed on said flat base, a plurality of visual indicia design swing lines disposed on a top of one of said side rails, and a sensor disposed in one of said side rails, said sensor connected to an electric source and walls of said side rails and said flat base, whereby when a putter head of a golf putter touches at least one surface of said walls or flat base the sensor indicates the necessity for correcting the swing of a practicing golfer.

2. The golf putting practice device of claim 1, wherein said front and rear walls have a "V" shaped top surface thereof for accommodating an arc-style swing track.

3. The golf putting practice device of claim 1, wherein a front wall is thicker than a rear wall for maintaining the plurality of visual indicia design swing lines thereon.

4. The golf putting practice device of claim 3, wherein said plurality of visual indicia design swing lines are symmetrically located at left and right top surfaces of said front wall for indicating back and finishing swing distances of the practicing golfer.

5. The golf putting practice device of claim 1, wherein said sensor further includes beam emitting sensors and beam receiving sensors for detecting when a putter head does not squarely cross with a surface of the flat base.

6. The golf putting practice device of claim 5, wherein said sensor is further connected to a buzzer for activating when the putter head of the golf putter does not squarely cross with the surface of said flat rectangular shaped base for correcting the swing of the practice golfer.

7. The golf putting practice device of claim 1, further including an induction lamp disposed on one of said side rails.

8. A golf putting practice device comprising:

a guide member including a flat base, a pair of elongated vertically spaced apart and generally parallel side rails disposed along said flat base, a plurality of visual indicia design angle lines disposed on said flat base, a plurality of visual indicia design swing lines disposed on a top of one of said side rails, and beam emitting sensors and beam receiving sensors for detecting when a putter head does not squarely cross with a surface of the flat base.

9. The golf putting practice device of claim 8, further including an induction lamp disposed on one of said side rails.

* * * * *